US006101355A

United States Patent [19]

Matsumoto et al.

[11] Patent Number: 6,101,355

[45] Date of Patent: Aug. 8, 2000

[54] LIQUID DEVELOPMENT APPARATUS

[75] Inventors: Shogo Matsumoto, Ushiku; Akira Mori, Ibaraki-ken; Junichi Matsuno, Tsuchiura; Keiji Kamio; Mitsuo Suzuki, both of Hitachi, all of Japan

[73] Assignee: Hitachi, Ltd., Tokyo, Japan

[21] Appl. No.: 09/336,686

[22] Filed: Jun. 21, 1999

[30] Foreign Application Priority Data

Jun. 25, 1998 [JP] Japan ..... 10-178385
Sep. 18, 1998 [JP] Japan ..... 10-264299

[51] Int. Cl.[7] ..... G03G 15/10

[52] U.S. Cl. ..... 399/239; 347/55; 347/112; 399/241

[58] Field of Search ..... 399/239, 240, 399/241, 237; 347/112, 55; 430/117, 118, 119, 105, 112

[56] References Cited

U.S. PATENT DOCUMENTS 4,761,357 8/1988 Tavernier et al. ..... 399/239 X
5,666,615 9/1997 Nguyen ..... 399/240
5,724,629 3/1998 Iino et al. ..... 399/57
5,752,142 5/1998 Staples et al. ..... 399/241

FOREIGN PATENT DOCUMENTS 5-035117 2/1993 Japan .
7-239614 9/1995 Japan .

*Primary Examiner*—Sophia S. Chen
*Attorney, Agent, or Firm*—Antonelli, Terry, Stout & Kraus, LLP

[57] ABSTRACT

Provided is a liquid development apparatus which can restrain carrier liquid in a liquid developer from being evaporated and diffused into the atmosphere, which has a simple and convenient arrangement, and in which a recording medium formed thereon with an electrostatic latent image in accordance with image data is transferred and the electrostatic latent image on the recording medium is developed by a developer in a liquid developer in which toner particles are dispersed. The liquid development apparatus includes a developer supply for feeding the developer containing non-volatile components having a density of 10 to 30 wt. %, a developer holding member having a surface roughness in a range from 8 to 25 $\mu$m Rz, for holding the developer fed from the developer supply, and a conductive member facing the developer holding member, interposing the latent image bearing recording medium on which the electrostatic latent image is formed, between itself and the developer holding member, for applying an electric filed between itself and the developer holding member in a direction in which the toner particles are shifted from the developer holding member toward the latent image bearing recording medium.

11 Claims, 10 Drawing Sheets

LIQUID DEVELOPMENT APPARATUS

BACKGROUND OF THE INVENTION

The present invention relates to a liquid development apparatus which carries out tonal density development per pixel for recording, and which uses a liquid developer for developing a latent image including half tone image parts so as to loyally develop the image with the use of micro toner particles in order to obtain a high quality developed image.

A liquid development apparatus, that is, a development apparatus using a liquid developer, can use micro toner particle toner having a particle size of less than 1 $\mu$m, and accordingly, can effect such an advantage that a high quality image which is loyal to a latent image to be developed can be obtained. However, in the liquid development apparatus, a low density developer having a toner density of less than 1 mass % has to be used for obtaining a sufficient image density, and accordingly, a developer circulating system for feeding a large quantity of the developer to an image part, and also for promptly retrieving the developer after development should be required. Accordingly, the development apparatus has to be large-sized and complicated so as to be disadvantageous. Further, a density control mechanism for supplying the liquid developer has to be required in order to replenish for a decrease in the quantity of toner particles during development, and accordingly, it also cause the liquid development apparatus to be large-sized and complicated.

In order to miniaturize such a wet-type liquid development apparatus, it is required to eliminate the developer circulating system from the development apparatus while maintaining the supply of a developer sufficient to a latent image. Accordingly, it has been proposed that liquid developer having a toner density which is higher than that of a liquid developer usually used in a conventional liquid development apparatus, is used in order to supply toner sufficient to a latent image while reducing the supply volume of the liquid developer. AS to such prior art, for example, International Publication WO95/15516 (International Publication No. PCT/JP94/02034) discloses such a technology.

As disclosed in this document, a liquid development apparatus for developing a latent image formed in a photosensitive medium with the use of toner, has a development belt, and a layer forming blade for regulating the thickness of a highly viscous liquid developer layer which is applied on the development belt and in which toner is dispersed at a high degree of density. With this arrangement, the liquid development apparatus disclosed in this document can uniformly supply a small quantity of liquid developer having a high degree of density and a high degree of viscosity onto a latent image surface on an image forming medium.

However, in the above-mentioned conventional technology, there has been presented the following disadvantage. That is, a pre-wet applying device is required, in addition to the development apparatus, in this technology, since pre-wet liquid which is dielectric liquid having a releasable function and being chemically inactive is applied on a photosensitive medium serving as an image bearing medium in order to prevent a non-imaging part from fogging. Thus, the image forming apparatus has such a disadvantage that the number of components is increased so as to incur a high cost. In order to reduce the number of components in the apparatus so as to miniaturize the apparatus as a whole, there is required such an arrangement that occurrence of fogging can be prevented with no provision of a pre-wet applying device as incorporated in the above-mentioned image forming apparatus.

Further, Japanese Laid-Open Patent No. H7-334007 discloses a wet-liquid development apparatus in which a developer having a toner density of 5 to 70% is used, and which is composed of a development apparatus body having its top end opened and formed in a liquid tight box-like shape, developer liquid contained in the development apparatus body and a developing roller partly soaked in the developer liquid within the development apparatus body, facing the outer surface of a photosensitive drum and adapted to be rotated in a direction reverse to the rotating direction of the photosensitive drum.

However, in the above-mentioned conventional technology, there has been presented the following disadvantage. That is, the distance between the photosensitive drum and the developing roller has to be more precisely controlled as toner having a higher density is used in order to prevent occurrence of the so-called fogging in a part of a recording sheet, other than an image part. However, it is very difficult to ensure a high degree of accuracy for the distance therebetween, and further, a problem of higher cost is raised.

Japanese Laid-Open Patent No. H9-185264 discloses an image recording apparatus composed of a developer container reserving liquid developer in which charged toner particles composed of at least a coloring agent and resin is dispersed in electrically insulative liquid, a supply roller for feeding the liquid developer from the developer container to a developing roller whose outer surface is therefor stuck thereover with the liquid developer, and a field applying means for applying an electric field to the liquid developer stuck on the outer surface of the developing roller so as to form a liquid toner layer in which charged toner is concentrated. This liquid development apparatus carries out development on a belt type photosensitive medium on which a latent image is created, with the use of the developing roller holding thereon the liquid toner layer in which the charged toner is concentrated.

However, in the case of this conventional technology, there has also be presented the following disadvantage. That is, it is required to control the traveling speed of the belt type photosensitive medium and the rotating speed of the developing roller so as to be equal to each other in order to prevent occurrence of the so-called smearing phenomenon in the contact parts of the belt type photosensitive medium and the developing rollers, which is caused by the toner on the developing roller since the toner is rubbed by the belt type photosensitive medium. Thus, there has been raised a problem of high cost because it is very difficult to control the relative speed between the belt type photosensitive medium and the developing roller.

BRIEF SUMMARY OF THE INVENTION

The present invention is devised in order to solve the above-mentioned problems inherent to the prior art, and accordingly, one object of the present invention is to provide a small-sized liquid development apparatus which can produce a fine image even though a liquid developer having a high density is used.

To the end, according to the present invention, there is provided a liquid development apparatus in which a recording medium on which an electrostatic latent image is created in accordance with an image signal, and the electrostatic latent image on the recording medium is developed by a developer in which toner particles are dispersed, comprising a developer supply means for feeding a developer having 10 to 70 wt. % of nonvolatile component density, a developer holding member having a surface roughness of 8 to 25

μmRz, for holding the developer fed from the developer supply means, a film thickness control member abutting against the developer holding member, for controlling the film thickness of the developer on the developer holding member, and a conductive member positioned so as to face the developer holding member, the recording medium on which the electrostatic latent image is created intervening therebetween, for applying an electric field between itself and the developer holding member so as to shift the toner toward a developing roller.

As mentioned above, by using the liquid development apparatus according to the present invention so as to carry out development with a developer having a high toner density, it is possible to eliminate the necessity of a density control mechanism for replenishing with a toner for a decrease in the quantity of toner particles during the development. Further, the liquid development apparatus according to the present invention can develop an image with less fogging caused by extra toner particles.

Further, it is preferable to apply an electric field in a range from 300 to 3,000 V/mm between the developer holding member and the conductive member.

A roller may be used as the developer holding member, and further, a belt may also be used as the developer holding member.

It may be arranged such that the traveling direction of the developer holding member is reverse to that of the recording medium at the position where the developer holding member makes contact with the recording medium.

Further, the developer can be fed, sufficient to ensure a required density for an image part by setting the traveling speed of the developer holding member to a value which is three times as high as the feeding speed of the recording medium.

In such a case that the developer holding member is a developing roller, a scoop-up roller soaked in the developer supply means may be used for feeding a developer from the developer supply means into the developer.

Still further advantages of the present invention will become apparent to those ordinarily skilled in the art when reading and understanding the following detailed description and the invention.

BRIEF DESCRIPTION OF THE ACCOMPANYING DRAWINGS

The invention will be detailed in the form of preferred embodiments with reference to the drawings which are:

DETAILED DESCRIPTION OF THE INVENTION

Explanation will hereinbelow made of an embodiment of the present invention.

Figure 1:
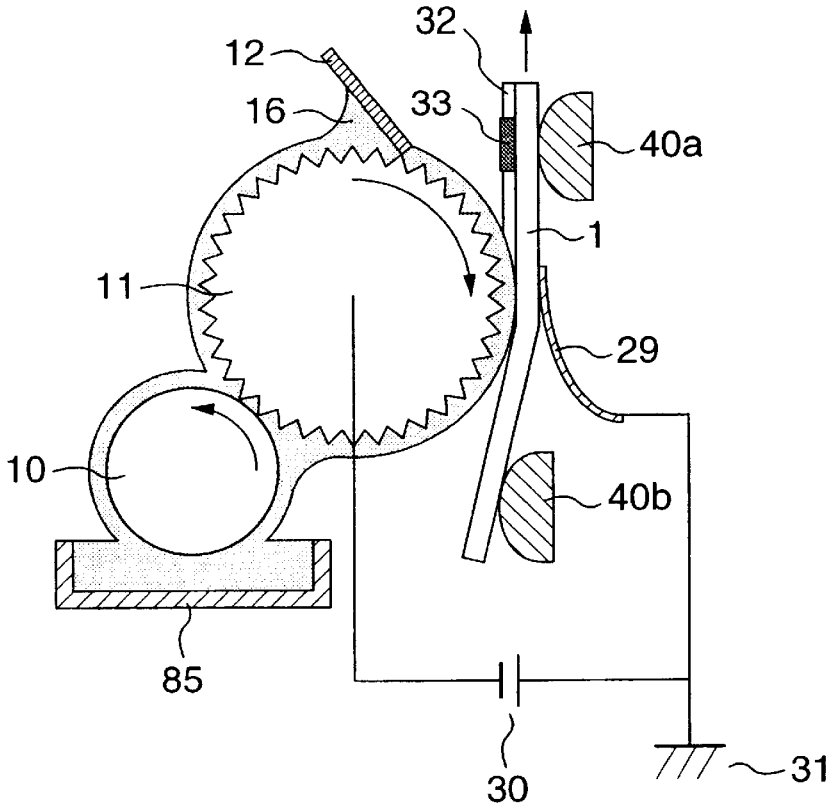
FIG. 1 is a schematic view illustrating a developing part of a liquid development apparatus in an embodiment of the present invention.

Referring to FIG. 1 which is a schematic view illustrating a developing part of a liquid development apparatus in an embodiment of the present invention, a developer holding part 85 is adapted to hold a predetermined quantity of a developer 16 in which charged toner particles are dispersed.

As to the developer, a liquid developer in which the density of toner is high is used in the present invention. It is noted that the toner density of a liquid developer which has been used in conventional liquid development apparatus is lower than 1 mass %. However, with the arrangement according to the present invention, even though a liquid having a density of nonvolatile components, which is higher than that in the conventional one, in a range from 10 to 30 wt % is used, it has been found that a satisfactory image can be obtained with no occurrence of fogging by extra toner on a recording sheet. The relationship between the liquid developer having a high toner density and the present invention will be detailed hereinbelow.

A scoop-up roller 10 is soaked in the developer 16 in the developer holding part 85, and is adapted to hold the developer 16 over the outer surface thereof in a film-like shape when it is rotated during development.

A developing roller 11 is pressed against the scoop-up roller 10 by a predetermined urging force. The developer 16 held on the outer surface of the scoop-up roller 10 is shifted onto the developing roller 11 which is rotated in a direction reverse to the direction of the rotation of the scoop-up roller 10. The developer 16 shifted onto the developing roller 11 from the scoop-up roller 10 is held on the outer surface of the developing roller 11 in a film-like shape so that the developing roller 11 serves as a developer holding member.

A blade 12 is pressed against the developing roller 11 by a predetermiend urging force so as to regulate the film thickness of the developer around the periphery of the developing roller 11. Adjustment of the gap between the developing roller 11 and the blade 12 can be regulated by providing a mechanism which is not shown, for manually or automatically adjusting a support part of the blade 12.

In this embodiment, the outer surface of the developing roller 11 is subjected to surface treatment so as to be finely roughened at a predetermined surface roughness, as will be hereinbelow detailed. Due to the fine surface roughness of the outer surface of the developing roller 11, the developing roller 11 can feed the developer 16, sufficiently, in comparison with the conventional one. Further, with the provision of the fine surface roughness of the outer surface on the developing roller 11, the developing roller 11 can sufficiently feed the developer 16 onto a recording medium 1 on which a latent image is formed, without the gap between the developing roller 11 and the recording medium 1 being precisely set.

The supply volume of the developer 16 onto the developing roller 11 by the scoop-up roller 10 has to be set to be greater than the volume of the developer 16 which has been fed onto the outer surface of the developing roller 11 after passing by the blade 12. Accordingly, the urging force of the scoop-up roller 10 pressed against the developing roller 11, the surface roughness of the outer surface of the scoop-up roller 10, the difference between the peripheral speeds of the scoop-up roller 10 and the developing roller 11 and the materials of these rollers are suitably selected.

It is noted that if the developer 16 whose toner density has been changed after development still remains on the developing roller 11 since the replacement of the developer 16 remaining on the developing roller 11 with the developer 16 fed by the scoop-up roller 10 cannot be perfectly made, the supply volume of the developer 16 by the scoop-up roller 10 should be set to be greater in view of the degree of efficiency of the replacement. By allowing a blade which is not shown, to abut against the developer roller 11, the developer 16 remaining on the developing roller 11 after development can be scraped off so as to enhance the efficiency of the replacement of the developer 16.

Figure 11:
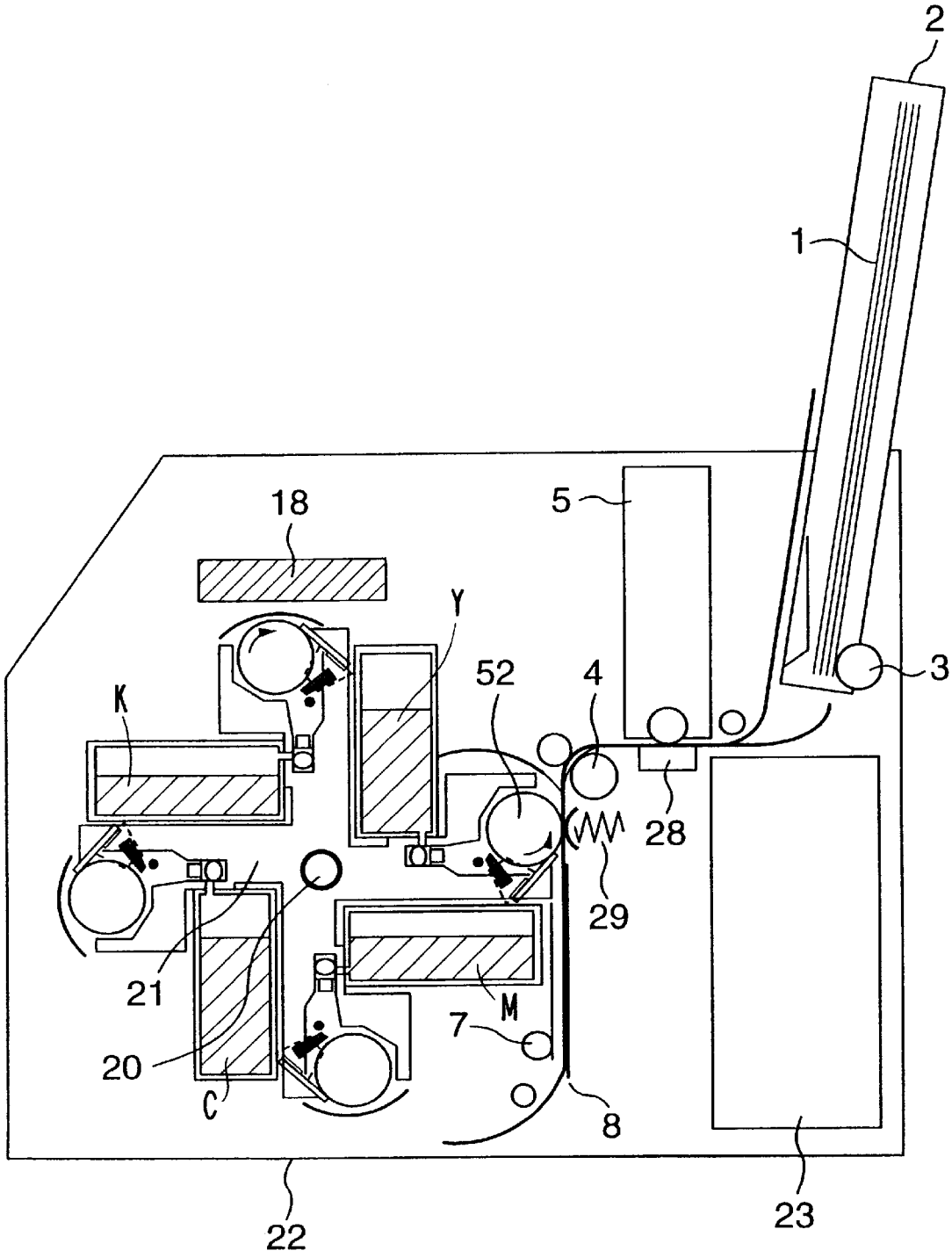
FIG. 11 is a schematic view illustrating a liquid development apparatus in an embodiment to which the present invention is applied.

The recording medium 1 is formed thereon with a latent image depending upon image data to be recorded on the surface of the recording medium, by a latent image forming means (which is, for example, composed of a recording head 5 and a back electrode 28 as shown in FIG. 11). The recording medium 1 is inserted between the developer roller 11 and a back electrode 29 by a transfer means 4 (refer to FIG. 11) for guiding and transferring the recording medium 1.

The back electrode 29 presses the recording medium 1 by a predetermined urging force, for developing a predetermined developing area in the longitudinal direction of the developing roller 11, in order to control the distance between the developing roller 11 and the recording medium 1. Further, the back electrode 29 may be formed of a resilient member so as to stabilize the contact between the developing roller 11 and itself.

During development for the recording medium 1, the developing roller 11 is rotated while the developer 16 is held on the outer peripheral surface thereof. Charged toner particles in the developer 16 are stuck to a latent image on the recording medium 1 so as to form a developed image 33 corresponding to the latent image on the recording medium 1.

In this case, a bias voltage for shifting the charged toner particles in the developer 16 onto the developer roller 11 is applied between the developing roller 11 and the back electrode 29 by a developing bias power source 30 grounded to earth 31 in order to prevent occurrence of fogging caused by toner particles sticking onto a non-developed part of the recording medium 1.

In the non-developed part, although no toner particles are prevented by the developing bias from sticking thereto, a solvent 32 in the developer 16 would stick thereto due to the surface tension of the solvent 32 with respect to the recording medium 1. The solvent 32 sticking to the non-developed part is then evaporated, and accordingly, it does not remain therein. In the conventional development apparatus in which a liquid developer having a low toner density is used, a large quantity of the developer has to be fed onto a latent image bearing medium (corresponding to the recording medium 1 in this embodiment) on which a latent image is formed. On the contrary, according to the present invention, the quantity of the developer fed onto the latent image bearing medium can be decreased. With this arrangement, the liquid development apparatus according to the present invention can constitute a recording apparatus causing less environmental contamination in comparison with a conventional system. It is noted here that the developing bias may be changed, depending upon an image, and further, that the arrangement of the developing bias part in this embodiment should not be the one which limits the scope of the present invention.

In this embodiment, sheet guides 40*a*, 40*b* are provided in order to constitute the transfer path at positions between which the developing roller 11 makes contact with the back electrode 29 in front and rear of the developing part so that the recording medium 1 is wound on the developing roller 11 by a predetermined winding angle.

Since the recording medium 1 is wound on the developing roller 11 by the predetermined angle, the developing area can be enlarged. Accordingly, the developing speed can be increased, and further, the margin for variation in the contact condition in the developing part can be increased, thereby it is possible to reduce unevenness in development.

It is noted that the transfer path for the recording medium 1 can be simplified since the number of components in the apparatus is decreased due to such an arrangement that the sheet guides 40*a*, 40*b* can be connected and integrally incorporated with each other, and accordingly, the transfer of the recording medium 1 can be further stabilized.

In this embodiment, the recording medium 1 is formed with a conductive layer on the side on which it makes contact with the sheet guides 40*a*, 40*b*, that is, remote from the side on which the latent image is formed thereon. In such a case that a sheet guide in which the sheet guides 40*a*, 40*b* are integrally incorporated with each other is used, a developing bias may be applied by the developing bias power source 30 between the sheet guide and the developing roller 11, and accordingly, it is possible to prevent occurrence of fogging due to the function of the conductive layer even though the back electrode 29 in the developing part is not pressed against the recording medium 1.

Figure 2:
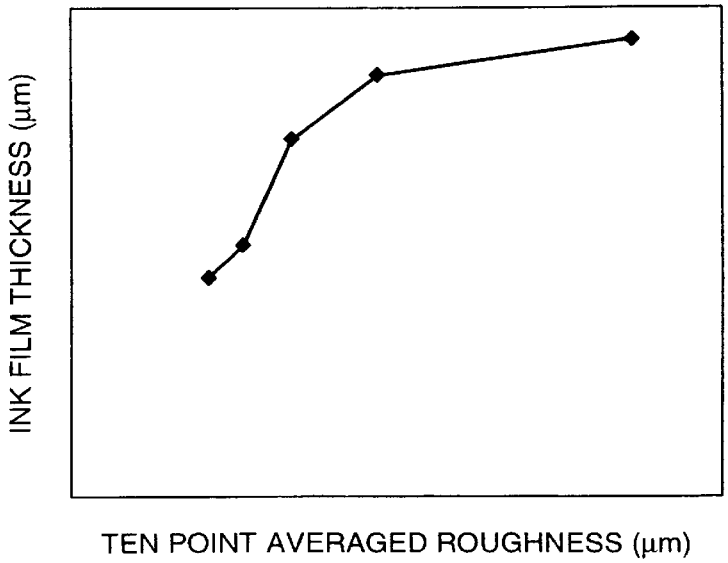
FIG. 2 is a graph showing a relationship between the surface roughness of a developing roller and the thickness of a film of ink on the developing roller.

Next, the relationship between the surface roughness of the developing roller and a printing condition will be explained with reference to FIGS. 1 and 2 and Table 1. As mentioned above, in this embodiment, the outer surface of the developing roller 11 is subjected to surface treatment so as to be finely roughened.

As mentioned above, during the formation of a thin film of the developer 16 on the developing roller 11, the flow of the developer 16 is regulated by the blade 12 pressed against the developing roller 11 by the predetermined urging force and the unevenness of the outer surface of the developing roller 11 so as to control the film thickness of the developer 16. Further, in order to carry out development, the gap between the developing roller 11 and the recording medium 1 pressed against the developing roller 11 by the back electrode 29 by the predetermined urging force, can be ensured by the surface roughness of the developing roller 11.

If the surface roughness of the developing roller is small, the thickness of the film of the developer formed on the developing roller 11 becomes smaller, and accordingly, the developer 16 by a quantity required for obtaining a sufficient toner density (for example, a reflection density of higher than 1.3) can be hardly supplied. Meanwhile, if the surface roughness of the developing roller 11 is large, the thickness of the film of the developer formed on the developing roller 11 becomes large, fogging likely occurs since the toner sticks to a non-developed part of the recording medium 1. In order to prevent occurrence of this problem, the voltage of the developing bias power source 30 for applying a required developing bias between the developing roller 11 and the back electrode 29 should be higher, and accordingly, the range of latent image potential which can be used for forming an image would be small. Thus, the surface roughness of the developing roller has to be appropriately set. Further, if the surface roughness is maintained to be constant, rounded crests of the surface roughness has a less possibility of damaging the recording medium, in comparison with sharp crests of the surface roughness, and accordingly, a more satisfactory image can be obtained.

Table 1 shows results obtained by experiments carried out by the inventors as to the relationship between the surface roughness and the printing condition.

TABLE I

Relationship between Surface Roughness and Printing Condition

| Surface Roughness Averaged at 10 Points | Printing Condition | |
|---|---|---|
| (μm) | Density | Fogging |
| 6 | Difficult to enhance density | Fogging can be prevented |
| 8 | Slightly low density | Fogging can be prevented |
| 10 | Sufficient density can be obtained | Fogging can be prevented |
| 15 | Sufficient density can be obtained | Fogging can be prevented |
| 25 | Sufficient density can be obtained | Fogging occurs more or less |

The developing roller was formed of a roller made of SUS304 and having a diameter of 20 mm, and the outer surface of the roller was subjected to sand-blasting with glass beads while the surface roughness of the roller was controlled by changing the process condition therefor. As a result, it was confirmed that there is presented a range in which no fogging occurs in a non-developed part and a sufficient image density can be ensured, by setting the surface roughness to 8 to 25 μm Rz. Further, it is preferable that the surface roughness falls in a range from 10 to 15 μm Rz.

It is noted that, as to the surface roughness of the developing roller, a roughness curve per reference length of 0.8 mm was measured with the use of a probe type surface roughness meter SV-9524 (made by Mitshutoyo Co.), and thereafter, a surface roughness was calculated in view of the definition of roughness Rz averaged at 10 points, specified in Japanese Industrial Standard, JIS B 0601-1944, so as to obtain an averaged value at three points on the developing roller 11 in order to evaluate the surface-roughness.

It was found that the thickness of a film of the developer which is formed on the outer surface of the developing roller and which can ensure a sufficient image density with no fogging in a non-developed part is in a range from 5 to 20 μm.

The recording medium 1 used in this embodiment has a surface roughness 10 to 300 sec (surface roughness of paper or the like is measured as specified JIS P 8119). It has been found that unevenness occurs in an image part and a non-developed part if the surface roughness of the recording medium 1 becomes higher than the limit value.

Should a material through which the liquid developer permeate into the inside of the roller from the outer surface of the latter, for example, sponge which is porous and elastic, be used for the developing roller, materials constituting the roller would possibly be deteriorated by the developer having permeated in the roller, and further, the characteristic of the developing roller would be deteriorated by the developer which has permeated in the roller and which been solidified. Thus, it is preferable to use a material which can prevent the developer from permeating into the inside of the roller. In this embodiment, the developing roller 11 is made of stainless steel. However, it goes without saying that the roller may be also made of aluminum, hard plastic and the like.

Figure 3:
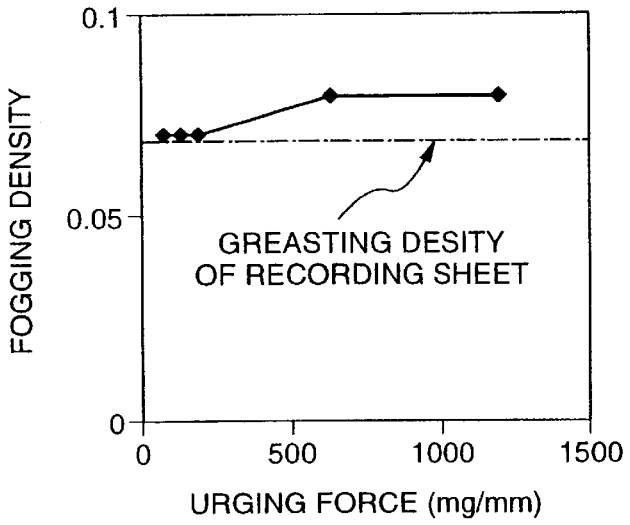
FIG. 3 is a graph showing a relationship between the press contact force of the developing roller and the density of fogging.

FIG. 3 shown the relationship between the press-contact force of a developing roller having a surface roughness of 10 μm Rz and the fogging density. It is found that development with no fogging in a non-developed part can be carried out if the force by which the developing roller 11 is pressed against a recording sheet is set be less than 200 mg/mm.

Figure 4:
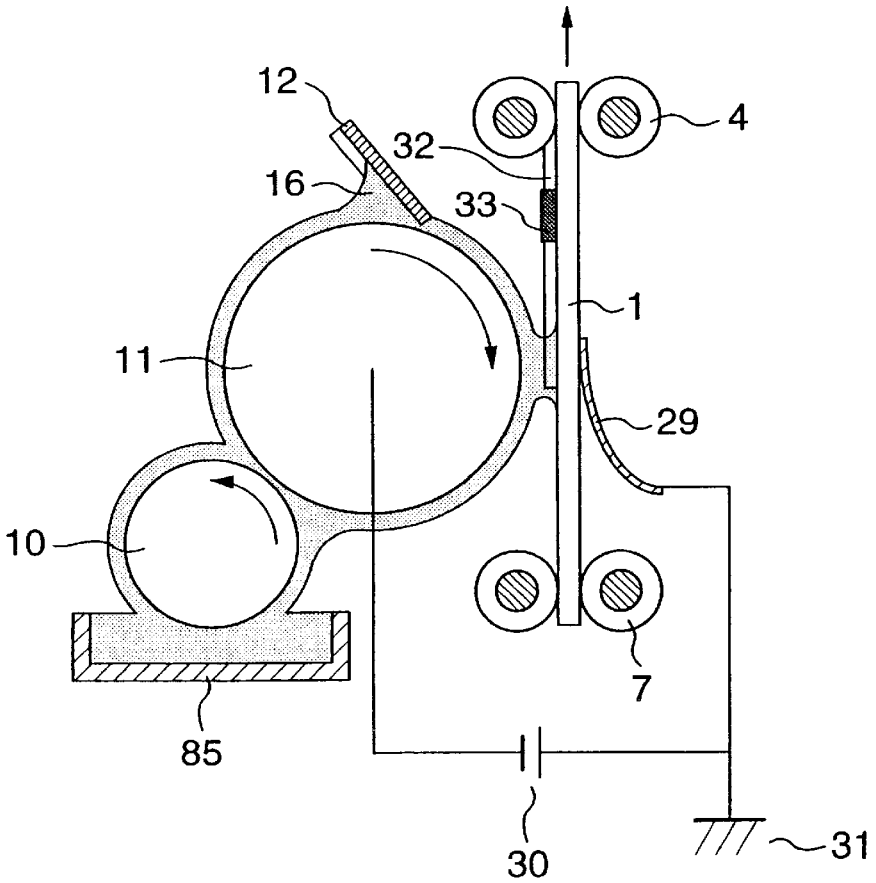
FIG. 4 is a schematic view illustrating a developing part of an development apparatus in an embodiment of the present invention.

Referring to FIG. 4 which is a schematic view illustrating a developing part in a liquid development apparatus in another embodiment of the present invention, and in which like reference numerals are used to denote like parts shown in FIG. 1 in order to omit the detailed explanation thereof, a developing blade 12 formed, in its surface abutting against the developing roller, with a plurality of grooves which are substantially parallel with the rotating direction of the developer roller, is pressed against the developing roller 11 in order to control the film thickness of a thin liquid developer layer on the developing roller 11. The film thickness of the thin liquid developer layer on the developing roller 11 can be controlled by the gap between the developing roller 11 and the developing blade 12, but sufficient rigidity should be ensured for all components thereof so as to severely control the precision of dimensions thereof in order to maintain the gap between the developing roller 11 and the developing blade 12 to be constant over the entire length of the developing roller 11. Thus, there has been, in a conventional arrangement, a risk such that the apparatus becomes large-sized and expensive. However, with the arrangement according to this embodiment, the gap can be precisely controlled over the entire length of the developing roller by ensuring accuracy only for each of the grooves, thereby it is possible to form a thin film of the developer with a simple structure.

In this embodiment, the recording medium 1 is transferred by a pair of paper feed rollers 4 for transferring the recording medium 1 at a predetermined transfer speed (process speed)

toward the top part of the figure, and a pair of guide rollers 7 which generate a rotational load torque so as to apply tension to the recording medium 1 in the developing area in order to stabilize the contact between the recording medium 11 and the developing back electrode 29 and also stabilize the distance between the developing roller 11 and the recording medium 1.

In this embodiment, the latent image is formed on the left side of the recording medium 1 in the figure, and is introduced between the developing roller 11 and the developing back electrode 29 by a transfer means which is not shown, for guiding and transferring the recording medium 1.

It is noted that the recording medium 1 may be fixed to a conductive transfer drum which is rotated at a predetermined speed in order to constitute the liquid developing apparatus according to the present invention although the recording medium 1 is transferred by the paper feed rollers 4 and the guide rollers 7 in this embodiment. It is noted that the distance between the recording medium 1 and the developing roller 11 is regulated by the positions of the transfer drum and the developing roller 11 in this arrangement, and further, the developing bias is regulated by a potential difference between the recording medium 1 and the developing roller 11. With this arrangement, the transfer of the recording medium can be stabilized.

With the use of a recording medium 1 formed with the conductive layer on a surface on the side remote from the side where the latent image is formed, the effect of the developing bias can be enhanced, and occurrence of fogging can be prevented even though the developing back electrode is not pressed against the recording medium in the developing part.

Figure 5:
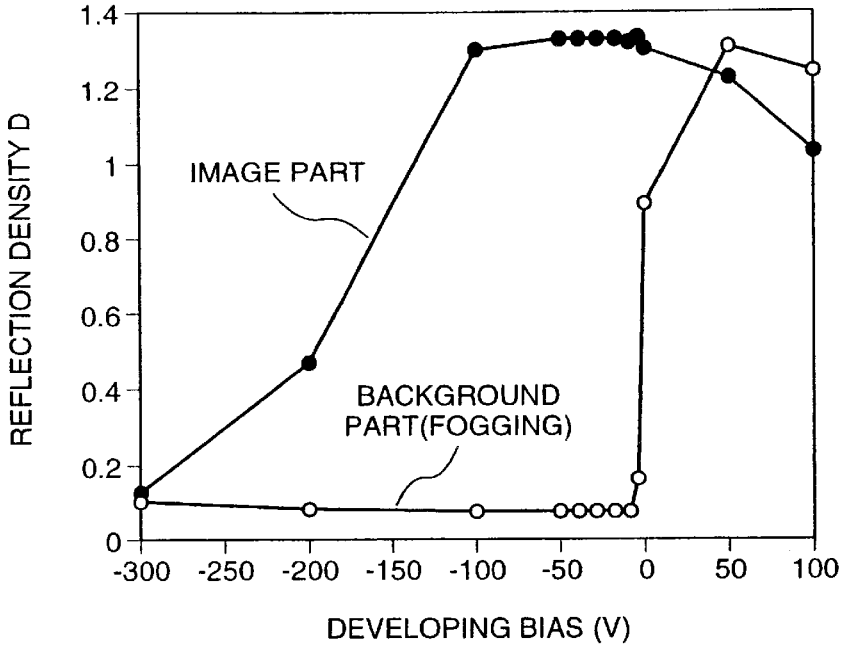
FIG. 5 is a characteristic view showing a relationship between the developing bias and the density of reflection after development.

FIG. 5 shows results obtained from experiments carried out by the inventors, as to the relationship between the developing bias and the reflection density after development.

The developing roller is made of SUS302, having a diameter of 20 mm, and is pressed thereagainst with the developing blade formed therein with a plurality of grooves in parallel with the rotating direction of the developing roller by an urging force of 120 N/mm so as to control the film thickness of the thin developer layer on the developing roller. In this embodiment, the width W, depth D and pitches P of the grooves are set to 96 $\mu$m, 31 $\mu$m and 126 $\mu$m, respectively. Further, during the experiments for the present invention, the film thickness of the thin developer layer on the developing roller was controlled to 15 $\mu$m.

As the recording medium, an electrostatically recording sheet used in an electrostatic plotter or the like was used, and the sheet was made into close contact with and fixed to a transfer drum made of aluminum, the dielectric layer side of the electrostatically recording sheet facing outside. A Scolothron was used for forming a latent image, and the grid voltage thereof is controlled so that the surface potential on the recording sheet is set to −140 V. Further, there were set as follows: the distance between the recording sheet and the developing roller, that is, the developing gap=30 $\mu$m, the peripheral speed of the recording sheet transfer drum, that is, the process speed=10 mm/s, and the peripheral speed of the developing roller=30 mm/s in a direction reverse to the direction of the transfer of the recording sheet (that is, the direction the same as the rotating direction of the developing roller or the sheet transfer drum). FIG. 5 shows variations in the reflection densities of an image part and a background part (that is, a non-developed part where no latent image is formed), in such a case that the sheet transfer drum was grounded, and the developing bias applied to the developing roller was changed from 100 to −300 V. It is noted that the densities were measured by a reflective densitometer (Macbeth RD918).

At first, as to the background part, toner sticks to a part where no latent image is formed when the bias voltage is set to zero, that is, it is found that no satisfactory development was carried out. As the developing bias is increased in the positive direction, the density increases. That is, since the toner sticks onto the recording sheet, being repelled from the developing roller which is positively charged since the toner in the developer on use is positively charged.

Meanwhile, as the developing bias is negatively increased from 0 V, it is found that no extra toner sticks to the background part, that is, a condition of no fogging can be obtained at a voltage higher than −10V.

Next, as to the image part, it is found that a sufficient reflection density can be obtained when the developing bias is in a range from −10 to −100 V, but the reflection density is lowered to a value by which no sufficient density can be obtained, when the developing bias is negatively increased from −100V. This is because a quantity of sticking toner onto the recording sheet depends upon a difference between an electric field induced by an electrostatic latent image and an electric field induced by the developing roller. Thus, it is unpreferable to increase the developing bias above the surface potential of the electrostatic latent image.

From the above-mentioned results, it has been found that a range in which the reflectiion density is satisfactory in the image part with no fogging in the background part is present by setting the developing bias in a range −10 to −100 V, that is, by setting the electric field in the developing part to be in a range from −300 to 300 V/mm.

Figure 6:
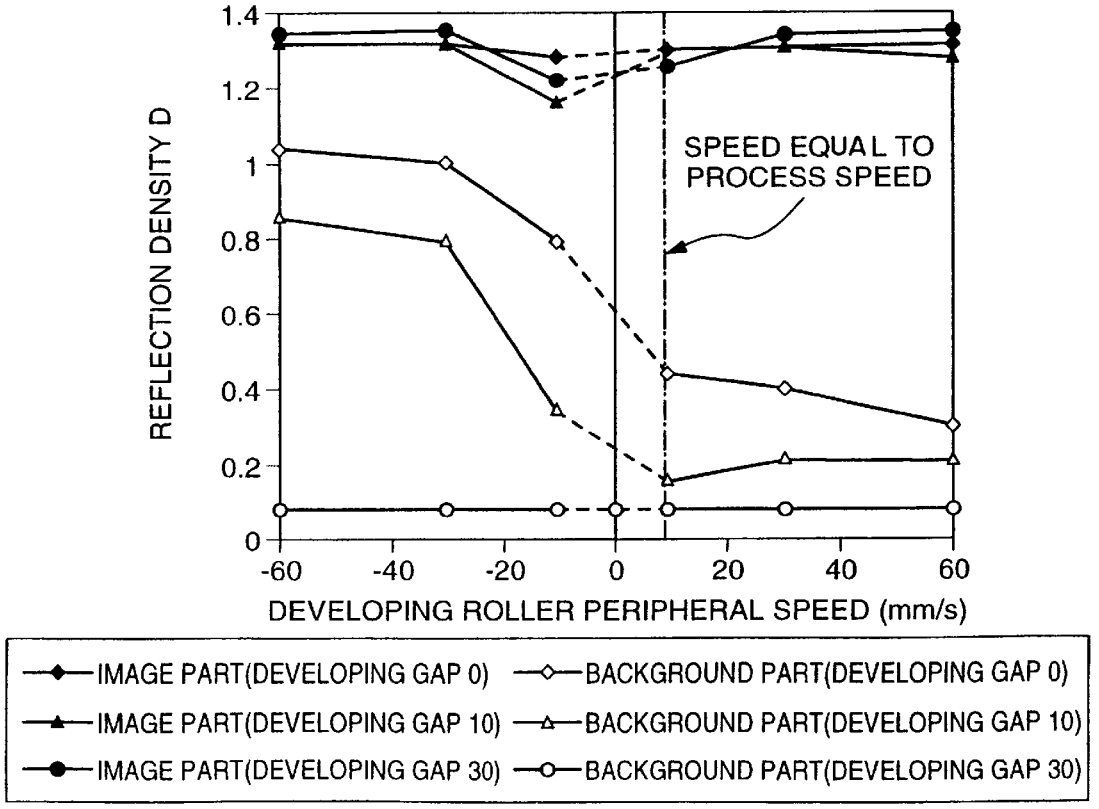
FIG. 6 is a characteristic view showing a relationship between the peripheral speed of a developing roller and the density of reflection after development.

Next, FIG. 6 shows results obtained from experiments carried by the inventors, as to the relationship between the peripheral speed of the developing roller and the reflecting density after development, when the developing gap was set to 0 $\mu$m, 10 $\mu$m and 30 $\mu$m, successively.

In this embodiment, the same test equipment as that shown in FIG. 5 was used while the developing gap and speed of the developing roller were changed during the experiments. The developing bias was set to a fixed value of −50V, and the potential of the latent image is set to a fixed value of −150 V. Further, as will be explained later, the film thickness of the developer on the developing roller was set to be substantially constant at 15 $\mu$m. The peripheral speed of the developing roller has a positive value if the vector of the peripheral speed is in a direction the same as the transfer direction of the recording sheet (the rotating direction of the developing roller is reverse to that of the sheet transfer drum), but has a negative value if it is in a direction reverse to the transfer direction of the recording sheet (the rotating direction of the developing roller is the same as that of the sheet transfer drum).

At first, as to the image part, when the peripheral speed is 10 mm/s, the density is slightly lowered in comparison with a case in which the peripheral speed is higher than this peripheral speed, irrespective of the rotating direction of the developing roller. This is because the developer cannot be fed, sufficient for developing a latent image having a surface potential of −150 V when the peripheral speed is 10 mm/s, and in this condition, unevenness in the density is observed in the image part. On the contrary, it is found that a substantially constant reflecting density can be obtained, irrespective of the developing gap and the rotating direction when the peripheral speed of the developing roller is higher than 30 mm/s.

Next, as to the background part, fogging occurs if the developing gap is smaller than the film thickness of the thin developer layer on the developing roller, and this tendency becomes remarkable as the peripheral speed of the developing roller has a negative value. This is because the developer is squeezed in the developing part by the developing gap which is smaller than the film thickness of the thin developer layer on the developing roller so as to create a sump of the developer fed to the developing part up to an area in which the developing bias can hardly act thereto, and accordingly, the effect of the developing bias for preventing occurrence of fogging becomes insufficient.

Figure 7:
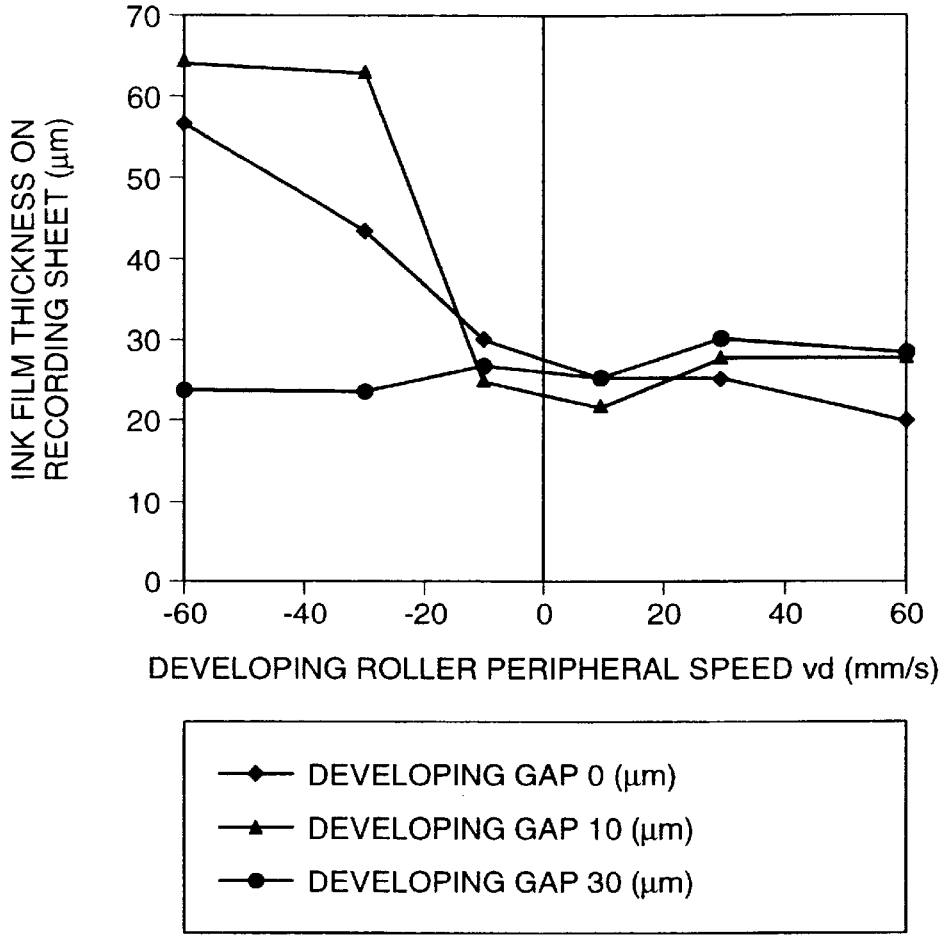
FIG. 7 is a characteristic view showing a relationship between the peripheral speed of the developing roller and the thickness of a film of ink on a recording sheet.

If the peripheral speed of the developing roller has a negative value, it is considered that the above-mentioned sump of the developer is created on the outlet side of the developing part in the transfer direction of the recording sheet, and accordingly, the developer containing toner is applied to the recording sheet, irrespective of a latent image. It is confirmed from the relationship between the peripheral speed of the developing roller and the recording sheet as shown in FIG. 7 since the film thickness of the developer sticking onto the recording sheet becomes larger as the peripheral speed of the developing roller is negatively increased in such a case that developing gap is smaller than the film thickness of the thin developer layer on the developing roller.

From the results mentioned above, it is found that the effect of the developing bias can be sufficiently exhibited so as to obtain a satisfactory image by setting the peripheral speed of the developing roller to a value exceeding a speed which is higher than three times as high as the process speed, and by setting the developing gap to be larger than the thickness of the thin developer layer on the developing roller. According to the present invention, it is possible to effectively prevent occurrence of fogging by the developer in the non-image part, which causes a problem in the case of using a developer having a high density for carrying out development, by setting the distance between the developer holding member and the recording medium to be greater than the film thickness of the developer on the developer holding member.

Figure 8:
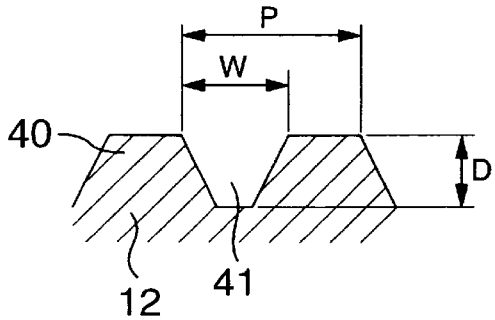
FIG. 8 is a side view illustrating a developing blade in an electrostatic recording apparatus in an embodiment of the present invention.

Referring to FIG. 8, which is a side view illustrating the developing blade used in an embodiment of the electrostatic recording apparatus according to the present invention, the developing blade 12 is composed of crest parts 40 adapted to make contact with the developing roller (which is not shown) so as to regulate the gaps, and blade trough parts 41 having a width W and a depth D, for flow passages for the liquid developer in cooperation with the developing roller, the blade crest parts 40 and the blade trough parts 41 being alternately arranged at pitches P in substantial parallel with one another, and extending, longitudinal of the developing roller.

Figure 9:
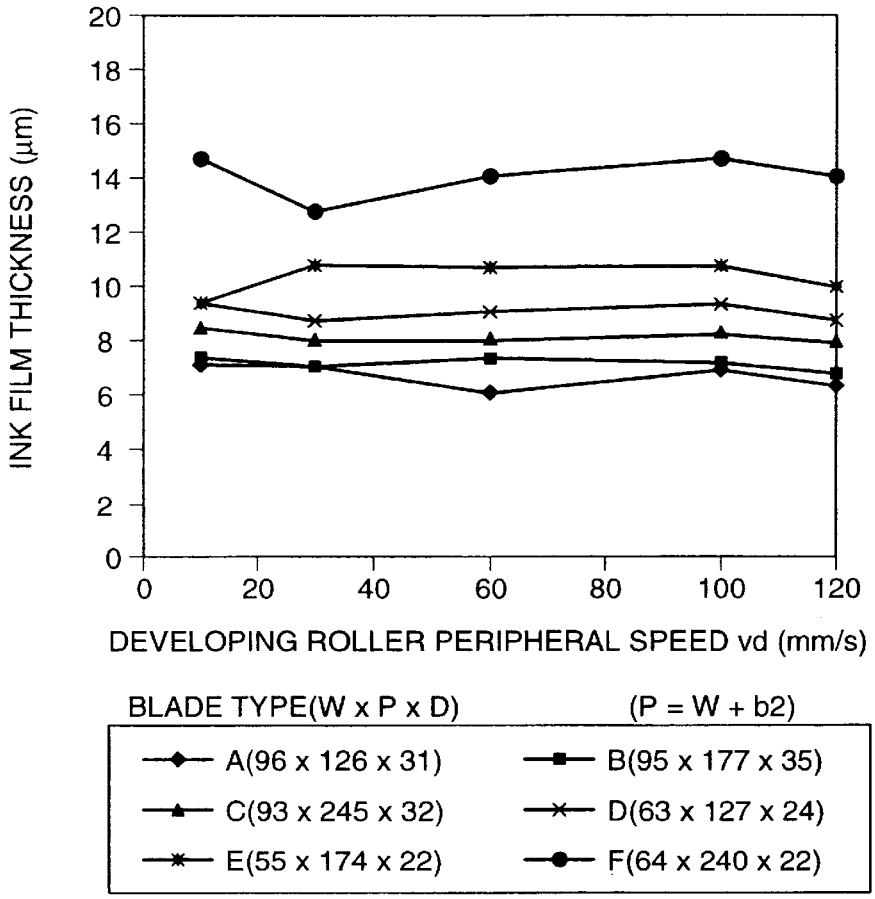
FIG. 9 is a characteristic view showing a relationship between the peripheral speed of a developing roller and the thickness of a film of a developer on the developing roller.

Next, FIG. 9 shows results which were obtained from experiments carried by the inventors, as to the relationship between the peripheral speed of the developing roller and the film thickness of the thin developer layer on the developing roller in such a case that the developing blade having a cross-sectional shape shown in FIG. 8 was used for forming a thin layer of the developer on the developing roller.

The figure also shows results obtained by changing the width W, the depth D and the pitches P of the blade trough parts. From these results, it is found that the thickness of the thin film of the developer on the developing roller can be controlled by changing the shape of the grooves formed in the developer blade, and further, this thickness does not affect the peripheral speed of the developer on the developing roller.

In this embodiment, the developing blade formed therein with the grooves are pressed against the developing roller having a smooth outer surface so as to control the film thickness of the developer on the developing roller. However, it is possible to control the film thickness of the developer on the developing roller by using such an arrangement that the outer surface of the developing roller is roughened while the developing roller is flatten and smooth.

Figure 10:
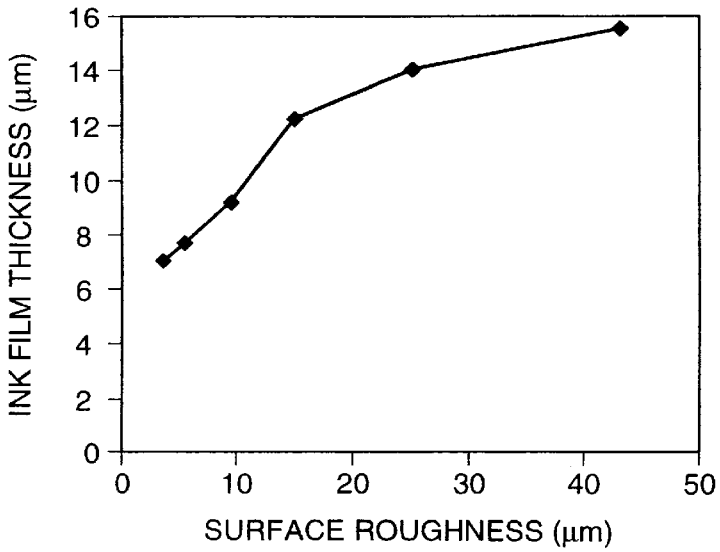
FIG. 10 is a characteristic view showing a relationship between the surface roughness of the developing roller and the thickness of a film of ink on the developing roller.

FIG. 10 shows results from experiments carried out by the inventors, as to the relationship between the surface roughness of the developing roller and the film thickness of the developer on the developing roller.

The developer roller was made of SUS304, having a diameter of 20 mm, and the outer surface thereof was subjected to sand-blasting with glass beads in order to control the surface roughness in accordance with a process condition of the sand blasting. The developing blade is a doctor blade made of Sweden steel, having a flat surface which makes contact with the developing roller. Further, the urging force of the blade pressed against the developing roller was 120 N/mm.

It is noted that the surface roughness of the developing roller was obtained in such a way that roughness curves having a reference length of 8 mm were measured by a probe type surface-roughness meter SV 9524 (made by Mitsutoyo Co.), then surface roughness was calculated in accordance with the definition of surface roughness Rz averaged at ten points as specified in JIS B 0601-1994, and the surface roughness was obtained from an averaged value among arbitrary three points on the developing roller.

From these results, it is confirmed that the film thickness of the developer on the developing roller can be controlled by a surface roughness of the outer surface of the developing roller, similar to the developing blade formed therein with the grooves. It is noted that the film thickness of the developer on the developing roller is substantially constant with no affection by the peripheral speed of the developing roller, and that the developing characteristic is also similar to that obtained by the developing blade formed therein with grooves.

Referring to FIG. 11 which is a schematic view illustrating an example of the liquid development apparatus having a liquid development apparatus body 22 according to the present invention. Recording sheets 1 are set in a hopper 2, and then, the delivery of an instruction for starting recording is waited for. A paper feed roller 3 is rotated in response to the instruction for stating recording, which is delivered from a control part 23 in a recording apparatus, so as to start feeding of the recording sheets 1 one by one. Further, the recording sheets are precisely transferred by the paper feed rollers 4 which clamp only opposite ends of each of the recording sheets. A recording head 5 which is located upstream of the paper feed rollers 4 in the transfer direction of the recording sheets 1, and which is opposed to a back electrode 28, the recording sheet 1 intervening between the recording head 5 and the back electrode 28, starts recording of an electrostatic latent image in a first color when one of the recording sheet 1 reaches a recording starting position which is not shown in the figure, being clamped by the paper feed rollers 4.

For example, the recording starting position is located at a position which is just after the position where the leading end of the recording sheet is clamped by the paper feed rollers 4. The positioning of the recording sheet 1 can be made by a paper feed value delivered from an optical reflection type sensor which is not shown or by the provision of an optical reflection type sensor provided in the vicinity of the recording head 5. It is noted that the recording head 5 in this embodiment is of ion-flow type.

It is noted that the recording head 5 or the back electrode 28 is retracted from a position where they are made into contact with the recording sheet 1, and accordingly, the recording sheet can hardly be stained. Further, during recording of an electrostatic latent image, the recording head 5 or the back electrode 28 is displaced by a gap holding mechanism which is not shown, until the distance between the recording head 5 and the back electrode 28 becomes a predetermined value so as to regulate a gap therebetween.

It is preferable to provide such an arrangement that the recording sheet 1 is released from paper supply rollers 3 when the recording sheet 1 is clamped by the paper feed rollers 4. With this arrangement, the load during transmission of the recording sheet 1 can be reduced.

When the recording head 5 starts recording the electrostatic latent image on the recording sheet 1, that is, for example, starts at first recording in yellow (Y), a developing roller 52 for yellow is shifted to a position where it faces the back electrode 29, that is, at a developing position by rotating a developing unit housing 21, and is then stopped at the position, and then the development in yellow is started. Alternatively, the back electrode 29 located at the developing position is shifted so as to regulate the gap between the developing roller and the recording sheet 1 before the development in yellow is started. In this embodiment, the gap between the developing roller and the recording sheet 1 is set to be such that they are made into slight contact with each other, and according no adjustment for the gap is required in the developing part. It is noted that the back electrode 29 is made of a soft elastic material so as to absorb an affection by a difference in the urging force, caused by an error in the displacement of the back electrode 29.

It is noted that the recording sheet 1 is prevented from making contact with the back electrode 29 or the developing roller 52, by rotating the developing unit housing 21 by an angle of 45 deg. around the rotary shaft 20 of the developing unit housing 21 in the figure, or retracting the back electrode 29 rightward in the figure, when the recording sheet 1 on which the electrostatic latent image is formed by the recording head 5 is transmitted to the developing part. With this arrangement, it is possible to prevent occurrence of erroneous transmission of the recording sheet 1, caused by buckling of the recording sheet 1 which possibly occurs when the recording sheet is inserted into the position where the back electrode 29 and the developing roller make contact with each other.

A plurality of developing rollers and the like are provided in the developing unit housing 21 so as to carry out development in magenta (M), development in cyan (C) and development in black (K), respectively, in addition to the development in yellow (Y), as shown in the figure. These colors will be hereinbelow denoted symbolically such as Y, M, C and K.

In U.S. patent application Ser. No. 09/146,350 "RECORDING APPARATUS" filed by the inventors, the above-mentioned developing unit housing 21 is discussed in detail.

According to the present invention, the back electrode 29 is electrically conductive. Further, toner in the developing part is applied by an electric field in a direction in which the toner is shifted toward the developing roller 52 so as to prevent occurrence of fogging by the toner in a non-image part. Further, the rotating direction of the developing roller is set to be reverse to the direction in which the recording sheet 1 is transferred, so as to reduce the quantity of carrier liquid remaining on the recording sheet 1 after development. With this arrangement, it is possible to restrain the carrier liquid from scattering into the atmosphere, and further the arrangement can become simple and convenient since no squeeze roller is required. This developing roller has a surface roughness which is regulated in a range from 8 to 25 $\mu$m Rz.

During the transmission of the recording sheet 1, the formation of the electrostatic latent image and the development thereof are carried out. The recording sheet 1 is further transmitted and is heated and dried by a sheet heater 8 serving as a heating means, and accordingly, a toner image is fixed on the recording sheet 1.

Thereafter, the developing unit housing 21 is rotated to separate the developing roller for Y from the developing part while the recording sheet 1 is transmitted in the reverse direction by rotating guide rollers 7 which are provided at a position just after the position where the recording sheet 1 passes by the sheet heater 8, and the paper feed rollers 4 in the reverse direction until the recording sheet 1 reaches to a position where development of an electrostatic latent image in a second color such as M is started. Further, at this time, a developing roller in the second color such as M is positioned in the developing part. The developing roller for Y is shifted, after development, to a position opposed to the cleaning unit 18, where the liquid developer sticking to the developing roller is cleaned off.

In response to an image signal for the second color, recording of an electrostatic latent image for M is started in an image in Y on the recording sheet 1, similar to the first color. Further, the development in magenta can be carried out, similar to that in Y. Subsequently, recording in third and fourth colors is carried out similarly, so as to obtain a full color image. The recording sheet 1 formed thereon with a full color image is discharged from the liquid developing apparatus body 22, and is stacked in a tray.

It is noted here that the recording head 5 for forming an electrostatic latent image on the recording sheet is an ion-flow head which controls the throughput of ions generated from an ion generating source so as to form an electrostatic latent image on a recording medium in accordance with image data. This recording head may be a multi-stylus head in which several stylus electrodes are selectively applied with voltages so as to form an electrostatic latent image on a recording medium. Further, if the recording medium is made of a photosensitive material, the recording head 5 may be a laser generator or a LED array which have been used in a conventional laser beam printer or an LED printer.

Figure 12:
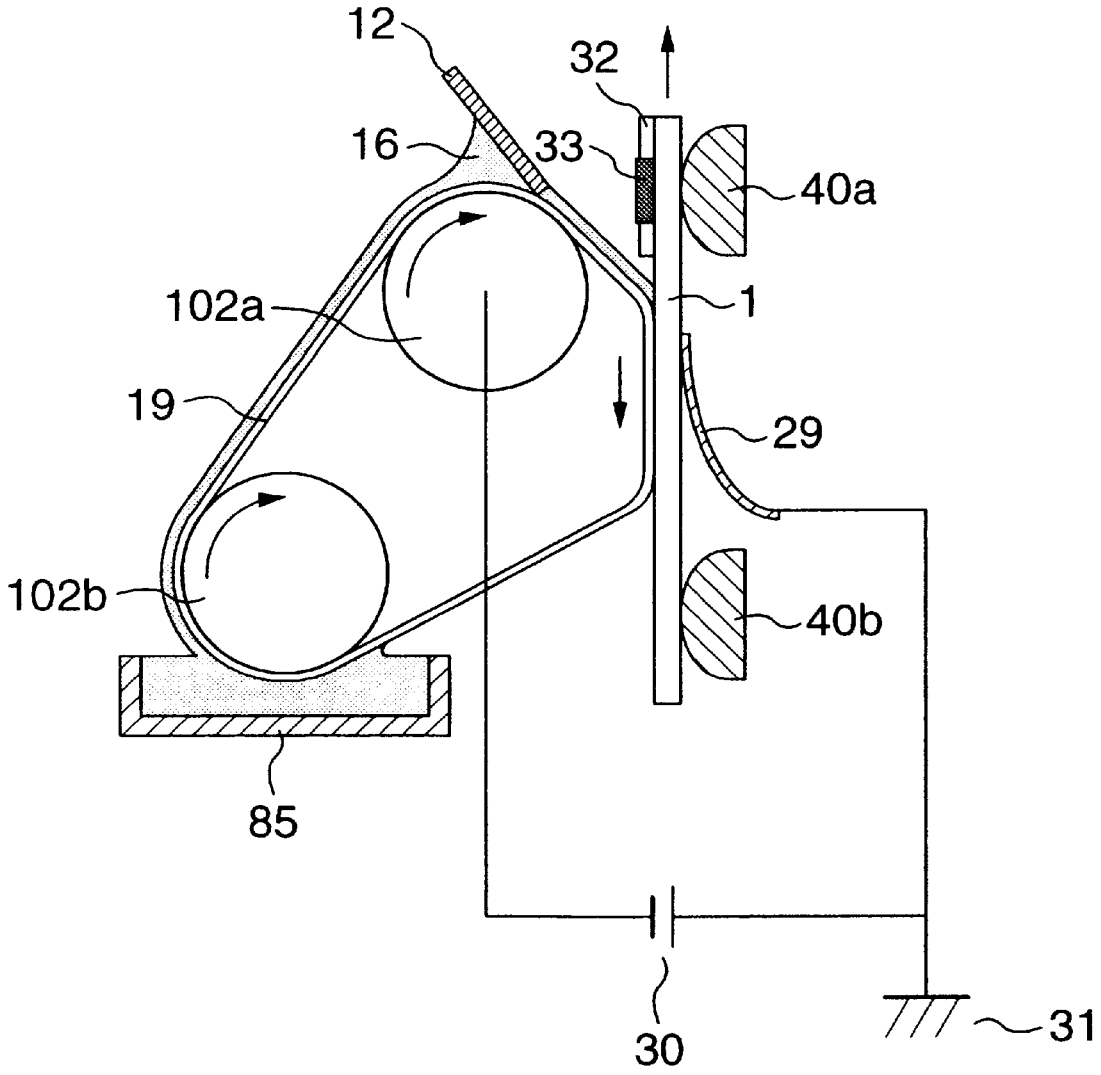
FIG. 12 is a schematic view illustrating a developing part in a liquid development apparatus in another embodiment of the present invention.

Referring to FIG. 12 which is schematic view illustrating a developing part in a liquid development apparatus in another embodiment of the present invention.

A developer holding part 85 holds therein a predetermined quantity of developer 16 in which charged toner particles are dispersed.

A cylindrical developing belt 19 being a developer holding member is rotated by belt drive rollers 102*a*, 102*b* which are internally made into contact with the cylindrical developing belt 19. A part of the developing belt 19 is soaked in the developer 16 in the developer holding part 85 together with the drive roller 102*b*, and is adapted to be rotated during development so as to carry or hold the developer on the outer peripheral surface thereof in a film-like shape. This developing belt 19 has a surface roughness regulated in a range from 8 to 25 μm Rz.

A blade 12 is pressed against the developing belt 19 by a predetermined urging force through the intermediary of drive roller 102*a* so as to regulate the film thickness on the peripheral surface of the developing belt 19.

In this embodiment, fine roughness is formed in the outer peripheral surface of the developing belt 19 by surface treatment so as to have a predetermined surface roughness, and accordingly, the gap between itself and the blade 12 can be regulated by a simple system. Further, the belt drive rollers 102*a*, 102*b* are arranged so as to alow the developing belt 19 to slack, and the developing belt 19 is made into contact with the recording medium 1 on the side where the developing belt 19 slacks.

In this embodiment in which the transfer passage for the recording medium is formed substantially in a straight-line shape so as to ensure a wide developing area, the developing speed is enhanced while the reliability of the sheet transmission is enhanced, and further, the margin for variation in the contact condition in the developing part is widened, thereby it is possible to reduce irrgularity in development.

It is noted, as mentioned above, that a scraping blade may abut against the developing belt 19 after development so as to scrape off the developer remaining on the developing belt, thereby it is possible to enhance the efficiency of replacement of developer.

Figure 13:
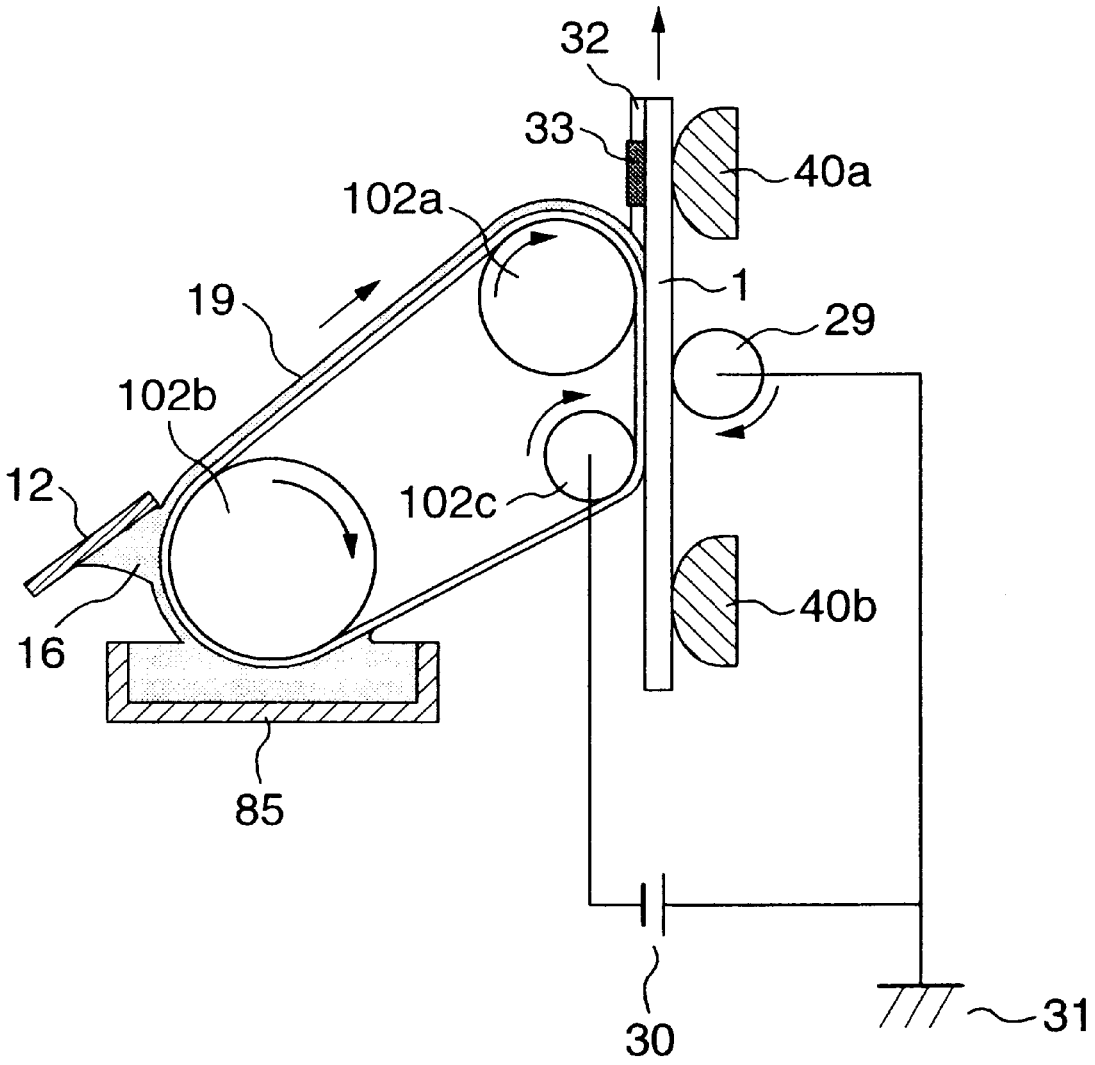
FIG. 13 is a schematic view illustrating a developing part in a liquid developing pa rt in a liquid development apparatus in a further another embodiment of the present invention.

FIG. 13 is a schematic view illustrating a developing part in a liquid development apparatus in a further another embodiment of the present invention.

This embodiment is the same as the embodiment shown in FIG. 12, except that a belt drive roller 102*c* making internally contact with the developing belt 19 is added. With this arrangement, the developing area can be stably formed.

It is noted that the back electrode 29 may be formed from a roller so as to be pressed against the belt drive rollers 102*a*, 102*c* therebetween by a predetermined urging force in order to stabilize the contact between the recording medium 1 and the developing belt 19. The developing belt 19 has a surface roughness which is regulated in a range from 8 to 25 μm, similar to the developing belt 19 in the embodiment shown in FIG. 12.

Figure 14:
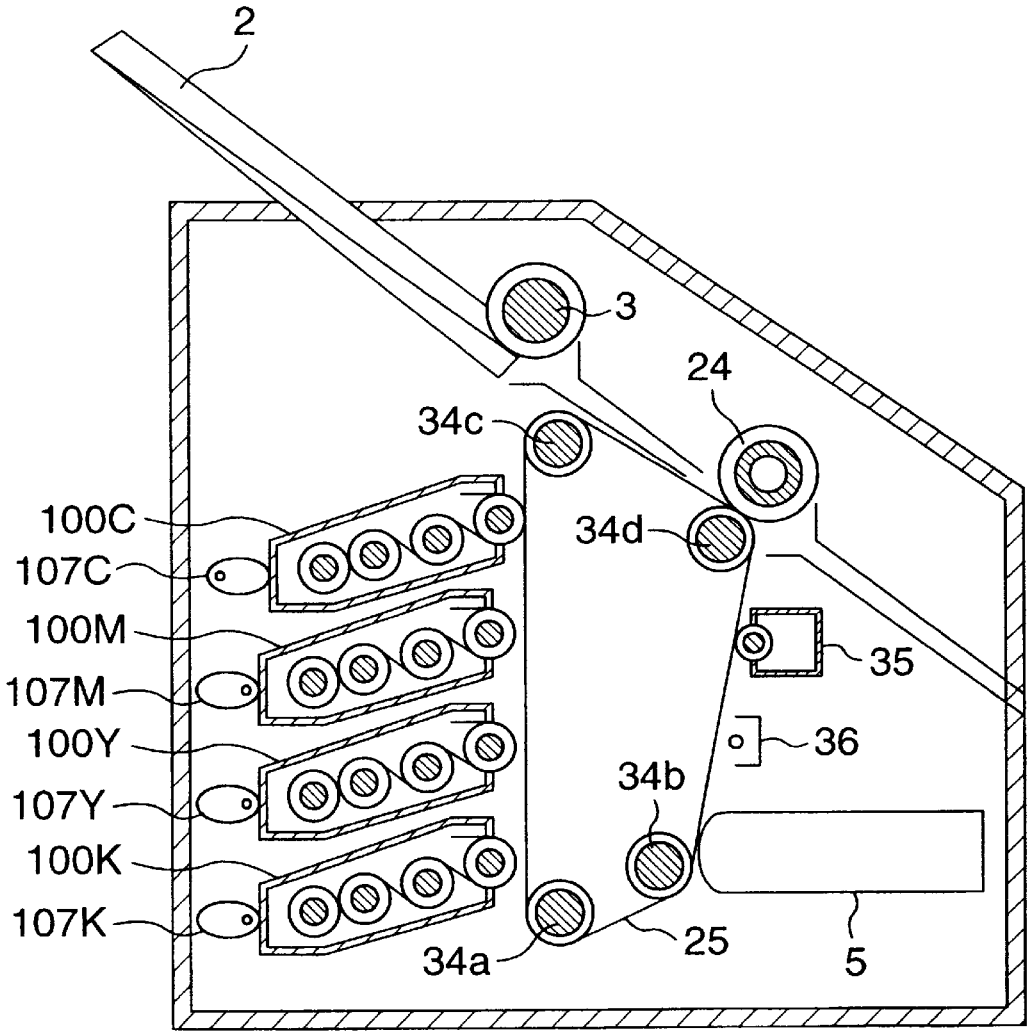
FIG. 14 is a schematic view illustrating another liquid development apparatus to which the present invention is applied.

In the case of using a normal recording sheet 1 which is not exclusive for the liquid recording apparatus, the recording head 5 forms an electrostatic latent image in accordance with image data once on a dielectric belt on which an electrostatic latent image can be formed, as shown in FIG. 14, and then, the latent image is developed by each of different color developing units indicated as 100C, 100M, 100Y and 100K. With the repetitions of this process by, for example, four times, a color image is formed on the dielectric belt 25. Thereafter, one of the recording sheets 1 is separated and transmitted, and accordingly, the color image is transferred onto the recording sheet 1 by an image transfer roller 24 incorporating therein a heating means.

In this embodiment, the selection of the development machine can be made by displacing developing units 100 (100C, 100M, 100Y and 100K) by means of developing unit swinging cams 107 (107C, 107M, 107Y and 107K) in the rightward direction in the figure, and pressing developing rollers for different colors against the dielectric belt 25 by a predetermined urging force. The developing rollers used in the developing unit 100 have a surface roughness which is regulated in a range from 6 to 25 μm, similar to the other embodiments of the present invention. The developing units 100 and the swing cams 107 have reference marks C, M, Y, K in order to distinguish development in a color from that in the other colors. It is noted that the urging force for pressing the developing roller against the dielectric belt 25 is regulated by a degree of tension of the dielectric belt 25 which is obtained by pressing one of a plurality of belt guide rollers 34 (34*a*, 34*b*, 34*c*, 34*d*) against the dielectric belt 25 by a predetermined urging force. Further, the transfer force of the belt guide rollers 34 is given in accordance with a frictional force of the belt guide roller 34.

The image-transfer roller 24 which is heated just before the image transfer, presses the dielectric belt 25 with the first timing at which the recording sheet intervenes between the dielectric belt 25 and the image transfer roller 24. The recording sheet 1 is heated and then pressed against the image surface, and accordingly, the image is transferred onto the recording sheet 1 which is then discharged outside of the apparatus.

Further, extra ink which sticks on the dielectric belt 25 and which has not been transferred onto the recording sheet 1 is wiped off by the belt cleaner 35 so as to prevent a next color image from being disturbed. Further, a uniform charger 36 to which an a.c. current AC is applied so as to produce negative and positive ions is provided downstream of the belt cleaner 35 so as to eliminate an affection by the previous color electrostatic latent image. It is noted here that it is possible to prevent occurrence of fogging in a non-image part by adding a bias to an input voltage to the uniform charger 36 so that it is charged in the same polarity as that of the charged polarity of the toner particles.

In this embodiment, there has been explained such a system that images in four colors are superposed one upon another on the dielectric belt 25, and are then transferred onto the recording sheet 1. However, the recording sheet 1 may be reciprocated by four times so as to form a full color imager thereon by carrying out the formation of an electrostatic latent image, development and image transfer and cleaning for each color. It is noted in this case that the degree of accuracy for paper feed by the sheet transfer system has to be well considered in order to maintain a high degree of accuracy for superposing images in different colors on the recording sheet.

Although the arrangement using the dielectric belt has been explained in this embodiment, such an arrangement that an electrostatic latent image is formed on a dielectric drum may also be realized.

Figure 15:
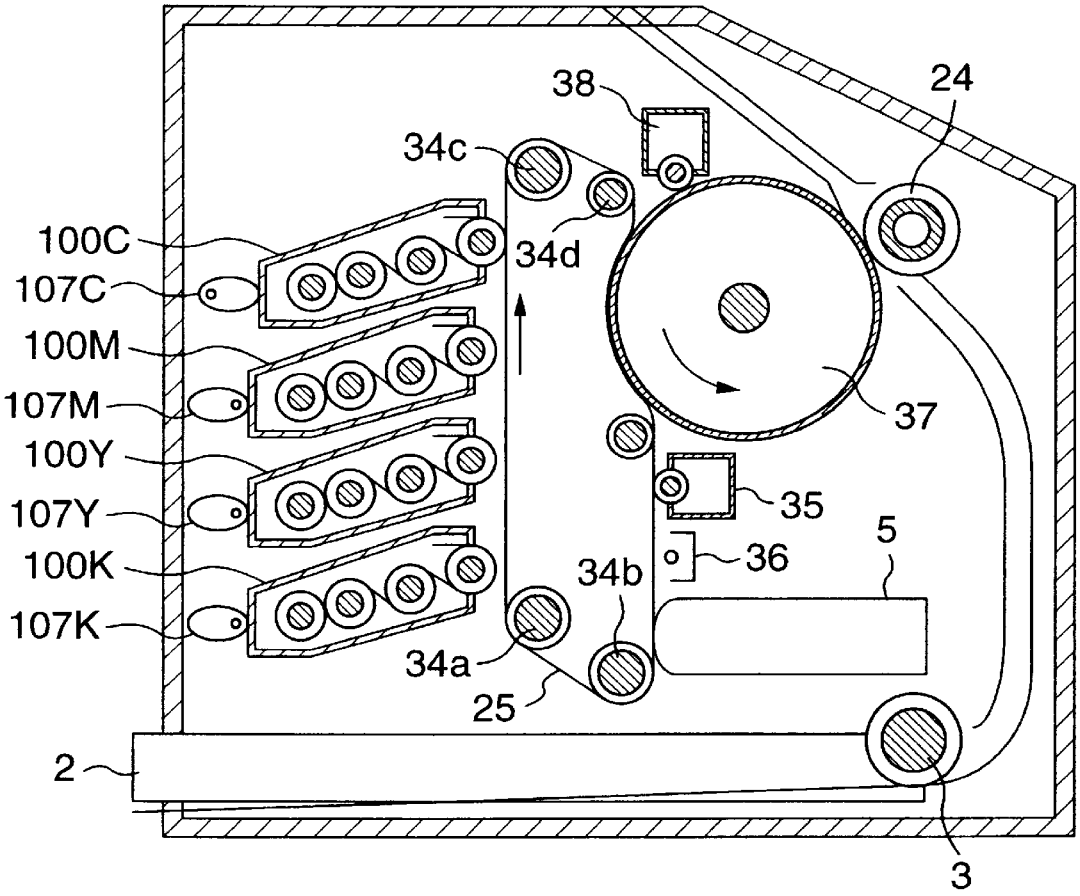
FIG. 15 is a schematic view illustrating a further another liquid development apparatus to which the present invention is applied.

FIG. 15 is a schematic view illustrating a further another embodiment of the present invention.

In this embodiment, a toner image formed on the dielectric belt 25 is transferred onto an image transfer drum 37, that is, four color images are superposed one upon another on the image transfer drum 37, and thereafter, they are transferred onto the recording sheet 1. In this arrangement, although the image transfer drum 37 and a drum cleaner 38 for cleaning the image transfer drum 37 are additionally required, it is possible to avoid mixing a previous color into a developing unit and disturbing a previously developed toner image since the dielectric belt 25 is cleaned for each color development, and accordingly, this arrangement is appropriate for obtaining a high quality image. Further, four color images are transferred onto the recording sheet at one and the same time, it is possible to superpose the color images with one another with a high degree of accuracy on the recording sheet 1.

According to the present invention, it is possible to restrain carrier liquid in a developer from being evaporated and diffused into the atmosphere since a developer having a high density is used, and accordingly, a required quantity of the developer can be fed while the toner density of the developer can be easily controlled so that the necessity of the provision of a developer circulating device as required in a conventional apparatus can be eliminated, thereby it is possible to constitute a liquid development apparatus which can use a developer having a high toner density with a simple and convenient system.

What is claimed is:

1. A liquid development apparatus in which a recording medium bearing thereon an electrostatic latent image in accordance with an image signal is transferred so as to develop the electrostatic latent image on the recording medium with a developer in which toner particles are dispersed, comprising:

a liquid developer supply means for supplying a liquid developer containing nonvolatile components having a density in a range from 10 to 30 wt. %;

a developer holding member having a surface roughness of 8 to 25 $\mu$m Rz, for holding the developer fed from the developer supply means; and a conductive member arranged so as to face said developer holding member, the electrostatic latent image bearing recording medium intervening therebetween, for applying an electrical field between itself and the electrostatic latent image in a direction in which the toner particles are shifted from said developer holding member onto the electrostatic latent image bearing recording medium for development of the electrostatic latent image.

2. A liquid development apparatus as set forth in claim 1, wherein said electric field is applied between said developer holding member and said conductive member and is in a range from 300 to 3,000 V/mm.

3. A liquid development apparatus as set forth in claim 1, further comprising means adapted to abut against said developer holding member, for controlling a film thickness of the developer on said developer holding member.

4. A liquid development apparatus as set forth in claim 1, wherein said developer holding member is moved in a direction reverse to the transfer direction of the latent image bearing recording medium at a position where said developer holding member and said electrostatic latent image bearing recording medium make contact with each other.

5. A liquid development apparatus as set forth in claim 1, wherein said developer holding member is moved at a speed exceeding a value which is three times as high as the transfer speed of the latent image bearing recording medium.

6. A liquid development apparatus as set forth in claim 1, wherein said developer holding member is a roller.

7. A liquid development apparatus as set forth in claim 6, wherein said developer is fed onto said roller by a scoop-up roller soaked in said developer supply means.

8. A liquid development apparatus as set forth in claim 6, wherein said electrostatic latent image bearing recording medium is urged onto said roller over a predetermined winding angle.

9. A liquid development apparatus as set forth in claim 1, wherein said developer holding member is a belt.

10. A liquid development apparatus as set forth in claim 1, further comprising a charger for uniformly charging said electrostatic latent image bearing recording medium at the same polarity as that of said toner particles before the electrostatic latent image is formed on said electrostatic latent image bearing recording medium.

11. A liquid development apparatus as set forth in claim 1, wherein said developer holding member is pressed against said electrostatic latent image bearing recording medium by an urging force which is 200 mg/mm.

* * * * *